US007702270B2

(12) United States Patent
Yoshida

(10) Patent No.: US 7,702,270 B2
(45) Date of Patent: Apr. 20, 2010

(54) FIXING DEVICE

(75) Inventor: Takeshi Yoshida, Yao (JP)

(73) Assignee: Kyocera Mita Corporation, Osaka (JP)

( * ) Notice: Subject to any disclaimer, the term of this patent is extended or adjusted under 35 U.S.C. 154(b) by 260 days.

(21) Appl. No.: 11/726,729

(22) Filed: Mar. 22, 2007

(65) Prior Publication Data

US 2007/0223975 A1 Sep. 27, 2007

(30) Foreign Application Priority Data

Mar. 24, 2006 (JP) ..... 2006-083575

(51) Int. Cl.
*G03G 15/20* (2006.01)

(52) U.S. Cl. ..... 399/323

(58) Field of Classification Search ..... 399/323, 399/322

See application file for complete search history.

(56) References Cited

U.S. PATENT DOCUMENTS 6,343,787 B1 * 2/2002 Kato et al. ..... 271/274
6,658,229 B2 * 12/2003 Ando et al. ..... 399/323
2002/0037186 A1 * 3/2002 Tanaka ..... 399/322
2003/0165348 A1 * 9/2003 Amita et al. ..... 399/323

FOREIGN PATENT DOCUMENTS

JP 2005031350 2/2005

* cited by examiner

*Primary Examiner*—David M Gray
*Assistant Examiner*—Gregory H Curran
(74) *Attorney, Agent, or Firm*—The Webb Law Firm

(57) ABSTRACT

Relates to a fixing device comprising a fixing part for fixing toner to a paper, and a separation mechanism to separate paper P from fixing body, separation mechanism has a separation member 12 with a shaft member 17 and a separation pawl 16, and a first urging mechanism 19 for urging separation pawl 16 to approach fixing body 2. To improve the device to suitably separate even a firmly adhered paper without damaging fixing body, a second urging mechanism 28 is provided for urging shaft member 17 toward initial position. Resultant force of pressing forces by two urging member 19, 28 is set such that shaft member 17 will be moved to the retracted position by a jammed paper P, and in a normal state, shaft member 17 will be prevented from moving to the retracted position even if paper P has a high adhesive force.

9 Claims, 10 Drawing Sheets

(a)

(b)

FIXING DEVICE

BACKGROUND OF THE INVENTION

1. Field of the Invention

The present invention relates to a fixing device in an image-forming apparatus.

More specifically, the present invention relates to a fixing device comprising:

a fixing part for conveying a sheet of paper that is held between a pressure body and a fixing body that are rotatably supported about substantially parallel shafts while simultaneously fixing supported unfixed toner; and a separation mechanism for separating the sheet of paper, which is carried away from the fixing part, from the fixing body or pressure body; wherein the separation mechanism has a separation member provided with a separation pawl for separating the sheet of paper and a shaft member, a support part for pivotably supporting the separation member via the shaft member so that the separation pawl can be brought near to and separated from the fixing body or pressure body, a first urging mechanism for urging the separation member in a direction in which the separation pawl approaches the fixing body or pressure body, and a control part for controlling the pivoting range of the separation pawl toward the fixing body or pressure body by applying a contact pressure;

the shaft member is provided so as to be movable between an initial position on the support part for the separation, and a retracted position that is set apart from the fixing part with respect to the initial position;

the urging force created by the first urging mechanism operates such that a pressing force is generated in a direction in which the shaft member is displaced from the retracted position toward the initial position; and the magnitude of the pressing force is set such that the shaft member is moved from the initial position to the retracted position by a contact pressing force exerted on the separation pawl by a jammed sheet of paper.

2. Description of the Related Art

An example of a fixing device according to prior art is disclosed in Japanese Laid-open Patent Application No. 2005-31350. In the fixing device according to the prior art, the magnitude of a pressing force created by a first urging mechanism that presses a shaft member toward an initial position is usually set to a value at which the shaft member is displaced from the initial position to a retracted position by a contact force exerted on a separation pawl by a jammed sheet of paper so that a state is not created in which the contact pressure created by the jammed sheet of paper causes the separation pawl to firmly press against a fixing surface or pressure surface and damage the fixing surface or pressure surface.

However, in the fixing device, even in a normal state in which a sheet of paper is not jammed, when a sheet of paper is firmly adhered against the fixing surface or pressure surface, the separating pawl, which is inserted between the adhering sheet of paper and the fixing surface or pressure surface, may be pressed by the adhered sheet of paper and made to resist the pressing force of the first urging member so that the shaft member will be moved to the retracted position. The separation pawl will be separated from a position preferable for separating the sheet of paper that is in the vicinity of the fixing part, and the sheet of paper will be impossible to be separated.

In order to resolve the foregoing problem, if the pressing force created by the elastic urging force of the first urging mechanism on the shaft member is set to a high value, the separation pawl will be pressed against the fixing surface or pressure surface with excessive force even in a normal state in which a paper jam has not occurred, and a risk arises that the fixing surface or pressure surface will be damaged by the separation pawl.

SUMMARY OF THE INVENTION

Therefore, in view of the foregoing circumstances of the prior art, it is an object of the present invention to provide a fixing device in which a fixing surface or pressure surface is not damaged in a normal state in which a paper jam has not occurred, and in which the sheet of paper can reliably be separated by the separation pawl even when the sheet of paper is firmly adhered to the fixing surface or pressure surface.

To achieve the above-described object, a first aspect of the present invention provides a fixing device comprising:

a fixing part for conveying a sheet of paper that is held between a pressure body and a fixing body that are rotatably supported about substantially parallel shafts while simultaneously fixing supported unfixed toner; and a separation mechanism for separating the sheet of paper, which is carried away from the fixing part, from the fixing body or pressure body; wherein the separation mechanism has a separation member provided with a separation pawl for separating the sheet of paper and a shaft member, a support part for pivotably supporting the separation member via the shaft member so that the separation pawl can be brought near to and separated from the fixing body or pressure body, a first urging mechanism for urging the separation member in a direction in which the separation pawl approaches the fixing body or pressure body, and a control part for controlling the pivoting range of the separation pawl toward the fixing body or pressure body by applying a contact pressure;

the shaft member is provided so as to be movable between an initial position on the support part for the separation, and a retracted position that is set apart from the fixing part with respect to the initial position;

the urging force created by the first urging mechanism operates such that a pressing force is generated in a direction in which the shaft member is displaced from the retracted position toward the initial position;

a second urging mechanism is provided that is separate from the first urging mechanism and that is used for pressing and urging the shaft member toward the initial position; and the magnitude of the resultant force of the pressing force created by the urging force of the first urging mechanism and the pressing force created by the urging force of the second urging mechanism is set such that, in a normal state in which a paper jam has not occurred, the shaft member can be prevented from moving from the initial position to the retracted position regardless of the magnitude of the adhesive force of the sheet of paper on the fixing body or the pressure body, and such that the shaft member is moved from the initial position to the retracted position by contact pressure exerted by a jammed sheet of paper on the separation pawl.

According to the above-described configuration, the second urging mechanism, which elastically urges the shaft member in the direction toward the control part, is provided as a separate member from the first urging mechanism. As a result, the pressing force that causes the shaft member to move toward the initial position is greater than the configuration in which only the first urging mechanism is provided. At the same time, the urging force that pivots and urges the separation pawl so as to move toward the fixing surface or pressure surface does not increase. Accordingly, no risk arises in regard to incidences wherein the separation pawl makes contact with the fixing surface or pressure surface in an excessively forceful manner.

The magnitude of the resultant force of the pressing force created by the urging force of the first urging mechanism and the pressing force created by the urging force of the second urging mechanism is set such that, in a normal state in which a paper jam has not occurred, the shaft member can be prevented from moving toward the retracted position regardless of the magnitude of the adhesive force of the sheet of paper, and such that the contact force of the jammed sheet of paper on the separation pawl will allow the shaft member to move toward the retracted position. Therefore, in a normal state, the shaft member will stop at the initial position even when the paper has a great adhesive force, and the separation pawl will reliably separate the paper. On the other hand, in a state in which a paper jam has occurred, the shaft member will be moved toward the retracted position by the contact force from the jammed sheet of paper, and the fixing surface or pressure surface will therefore be less likely to be damaged by the separation pawl.

In a second aspect of the present invention, a plurality of separation mechanisms is provided along shafts of the fixing body and pressure body, and a plurality of second urging mechanisms provided to each shaft member of the separation mechanisms has a plurality of flat-spring-shaped regions formed integrally on a single flat spring member.

According to the above-described configuration, a plurality of separation mechanisms is provided along the shafts of the fixing body and pressure body. Therefore, the sheet of paper is separated from the fixing surface and pressure surface at a plurality of locations in a width direction of the paper, and folding of the paper due to the action of the separation mechanism and other such events are less likely to occur. In addition, the second urging mechanisms provided to each of the shaft members of the separation mechanisms are composed of a plurality of regions that have the shape of a flat spring and are formed integrally with a series of flat spring members. Therefore, the second urging mechanisms are much simpler to be assembled than when the spring members are assembled one at a time for each separation mechanism.

DESCRIPTION OF THE PREFERRED EMBODIMENT

First Embodiment

FIG. 1 shows a color printer B as an example of an electronic photographic image-forming apparatus comprising a fixing device A according to the present invention. The color printer B has a paper cassette B1, a paper feeding unit B2, a manual tray B3, a manual tray paper-feeding unit B4, a magenta process unit B5, a cyan process unit B6, a yellow process unit B7, a black process unit B8, a transcription unit B9, the fixing device A, a discharge unit B10, and a face-down paper-ejection part B11.

As shown in FIG. 2, the fixing device A comprises a heating fixing roller 2 as a fixing body having a fixing surface 1, and a pressure roller 4 that comprises a pressing surface 3 that presses toward the fixing surface 1. The heating fixing roller 2 is rotatably supported around a shaft X1, and the pressure roller 4 is rotatably supported around a shaft X2 that is parallel to the shaft X1.

In addition, a fixing part 5 that can convey a sheet of paper P while fixing unfixed toner carried on the paper, and a discharge unit 9 through which the sheet of paper P on which the toner has been fixed is discharged are integrally incorporated in a fixing unit 6 that is removably formed as a unit in a main body of the printer.

The discharge unit 9 shown in FIGS. 2 and 3A are provided with the separation mechanism 8 for separating the fixed sheet of paper P from the fixing surface 1 and a plurality of gripping roller pairs 7*a*, 7*b* for gripping and conveying the separated sheet of paper P from the fixing part such as shown in FIGS. 6 and 7.

As shown in FIG. 3, the discharge unit 9 comprises a discharge housing 10 rotatably supported by the gripping roller pairs 7*a*, 7*b*. A separation unit 11 in which the plurality of separation mechanisms 8 is provided along the rotation shaft X1 of the heating fixing roller 2 is incorporated integrally in the discharge housing 10.

As shown in FIGS. 4 and 5, the separation unit 11 has a resin case 13 in which separation members 12 of the separation mechanisms 8 are incorporated. A plate metal stay 14 is affixed to the resin case 13, and a single plate-form metal spring member 15 (described hereunder) is mounted via the stay 14.

As shown in FIGS. 6 through 8, in the separation members 12 of the separation mechanisms 8, a separation pawl 16 for separating, on the basis of a pivoting action of the separation members 12, the sheet of paper P that is in the vicinity of the fixing surface 1 and that has adhered to the fixing surface 1, and a shaft member 17 for pivotably supporting the separation members 12 are formed in an integrally state.

In addition to the separation member 12, the separation mechanism 8 has a support part 18 for pivotably supporting the separation member 12 via the shaft member 17 of the separation member 12, a first urging mechanism 19 for elastically urging the separation member 12 so as to move the separation pawl 16 toward the fixing surface 1, and a control part 20 for controlling, on the basis of contact with a contacting part 12*a* provided between the shaft member 17 and separation pawl 16 of the separation member 12, the range in which the separation pawl 16 pivots toward the fixing surface 1. The control part 20 is formed integrally inside the case 13. A contact surface 24 for catching the contacting part 12*a* of the separation member 12 is formed on a distal end of the control part 20.

As shown in FIG. 7, the support part 18 has a left and right pair of support members 21 formed integrally inside the case 13, wherein a support surface 22 that extends horizontally in the drawing and a guide surface 23 that extends diagonally upward from the support surface 22 are formed sequentially in a slightly open L-shape in the support members 21.

A hook 25 sandwiching the shaft member 17 of the separation member 12 is formed on an end part on the side opposite the separation pawl 16. The first urging mechanism 19 comprises a tension coil spring 27 that spans between the hook 25 and a fixing hook 26 that is formed integrally with the case 13.

As described above, the tension coil spring 27 elastically pivots and urges the separation member 12 so that the separation pawl 16 moves toward the fixing surface 1. However, the pulling direction of the tension coil spring 27 extending from the moveable hook 25 to the fixing hook 26 does not form a right angle with the guide surface 23, but instead is in the vicinity of a corner part between the support surface 22 and the guide surface 23. Therefore, the elastic urging force of the tension coil spring 27 acts so that the shaft member 17 will be pressed along the guide surface 23 toward the support surface 22.

In a normal state in which a paper jam has not occurred at the separation mechanism 8, the shaft member 17, which extends in both left and right directions from the side surface of the separation member 12, is held in place at the corner part between the support surface 22 and guide surface 23 (initial position) by the urging force of the first urging mechanism 19.

In a normal state in which a paper jam has not occurred, the control part 20 that catches the contacting part 12*a* of the separation member 12 and the urging force of the first urging mechanism 19 operate to cause the distal end of the separation pawl 16 to be positioned close to the fixing surface 1 at a position that is conducive to separating the sheet of paper P, and prevent the distal end from coming excessively close to the fixing surface 1. FIG. 6 shows a normal state in which the separation pawl 16 separates the sheet of paper P from the fixing surface 1.

The shaft member 17 of the separation mechanism 12 slides diagonally upward in the drawing on the guide surface 23 as necessary. The shaft member 17 can thereby be moved to the retracted position, which is set apart from the initial position in an upward diagonal direction, as shown in FIGS. 9 and 10. In the retracted position, the separation pawl 16 is also further from the fixing part 5 than when at the position conducive to the separation of the sheet of paper P.

The magnitude of the urging force of the tension coil spring 27 is set such that the contact force exerted on the separation pawl 16 by the jammed sheet of paper P will move the shaft member 17 from the initial position along the guide surface 23 to the retracted position.

The separation mechanism 8 comprises an auxiliary spring 28 (second urging mechanism) that is provided separate from the tension coil spring 27 constituting the first urging mechanism 19, that is always in close contact with the shaft member 17, and that elastically urges the shaft member 17 toward the initial position.

As shown in FIGS. 6 through 8, the magnitude of the resultant pressing force created by the elastic urging force of the auxiliary spring 28 and the elastic urging force of the first urging mechanism 19 is set so that the shaft member 17 will resist the elastic urging forces of the tension coil spring 27 and auxiliary spring 28 caused by the contact pressing force exerted on the separation pawl 16 by the jammed sheet of paper, and will be able to move from the initial position to the retracted position; and so that, in a normal state in which a paper jam has not occurred, the shaft member 17 is prevented from moving from the initial position to the retracted position regardless of the magnitude of the adhesive force of the sheet of paper P on the fixing surface 1, as shown in FIGS. 9 through 10. Therefore the sheet of paper P can suitably be separated by the separation pawl 16 even when the sheet of paper P has firmly adhered to the fixing surface 1.

The position and angle of inclination of the guide surface 23 formed on the support member 21 are set so that, when the shaft member 17 is moved away from the control part 20 by the contact pressing force exerted by the jammed sheet of paper P, the distal end of the separation pawl 16 will not move along a tangential line of the heating fixing roller 2 so as to then be separated from the fixing surface 1 of the heating fixing roller 2, but will instead move along an arched contour of the fixing surface 1, i.e., will move while maintaining a slight distance from the fixing surface 1 of the heating fixing roller 2.

The auxiliary spring 28 is composed of a left and right pair of flat springs for pressing left and right end parts of the shaft member 17 toward the support surface 22, as shown in FIG. 8. More specifically, as shown in FIG. 4, the plurality of left and right pairs of flat springs 28 provided to each of the shaft members 17 of the separation mechanisms 8 are integrally formed by bending a portion of the above-described single plate-metal flat spring member 15. When a paper jam occurs, once the shaft member 17 has been moved from the initial position to the retracted position, the tension spring coil 27 is stretched while the auxiliary spring 28 is simultaneously deformed to a straight-line shape, as shown in FIG. 11.

Second Embodiment

Another embodiment of the second urging mechanism is shown in FIGS. 12 and 13. As shown in FIG. 12, a second urging mechanism 128 is composed of a spring member formed by bending a single wire member formed from a metallic material for springs. The spring member has a U-shaped linking part 30*a* extending in a substantially vertical direction; a pair of locking parts 30*b* that extend from a free edge of the linking part 30*a* in a horizontal direction parallel to one another; a pair of first transitional parts 30*c* extending parallel to one another from lower ends of the locking parts 30*b* in the horizontal direction; second transitional parts 30*d* extending upward from terminal ends of the first transitional parts 30*c*; third transitional parts 30*e* extending in the horizontal direction from terminal ends of the second transitional parts 30*d* toward a center; and a pair of pressing parts 29 extending in straight lines in the horizontal direction so as to return from terminal ends of the third transitional parts 30*e* toward the locking part 30.

As shown in FIG. 13, in a state in which areas near distal ends of the pair of pressing parts 29 strike left and right end parts of the shaft member 17, when the locking parts 30*b* lock onto a windowed part of the stay 14 and are fixed in place, the pair of pressing parts 29 elastically presses the shaft member 17 against the control part 20, and a process for affixing the second urging mechanism 128 to the stay 14 is complete. The configuration may be the same as that of the first embodiment in all other respects.

Third Embodiment

FIG. 14 shows a further embodiment of the second urging mechanisms wherein a pair of substantially rectangular urging members 129 composed of sponges or the like is mounted so that, in a state in which the urging members are pressed down in a vertical direction, the urging members are fitted between left and right end parts of the shaft member 17 and compression plates 131 that are formed by horizontally bending a portion of the stay 14. The shaft member 17 is elastically pressed against the control part 20 by the elastic restoring force created by the urging members 129 attempting to return to their original thicknesses. The configuration is the same as that of the first embodiment in all other respects.

Other Embodiments

1. A separation mechanism may also be provided that is capable of separating a sheet of paper being conveyed from the fixing part from the pressure surface of the pressing body instead of the fixing body.

2. The separation mechanism for separating the sheet of paper conveyed from the fixing part from the fixing body and the separation mechanism for separating [the sheet of paper] from the pressing body may both be provided.

3. The fixing body may be composed of an endless strip-shaped body that can be driven and rotated, and the outer peripheral surface thereof may serve as the fixing surface.

4. The pressing body may be composed of an endless strip-shaped body that can be driven and rotated, and the outer peripheral surface thereof may serve as the pressure surface.

Figure 1:
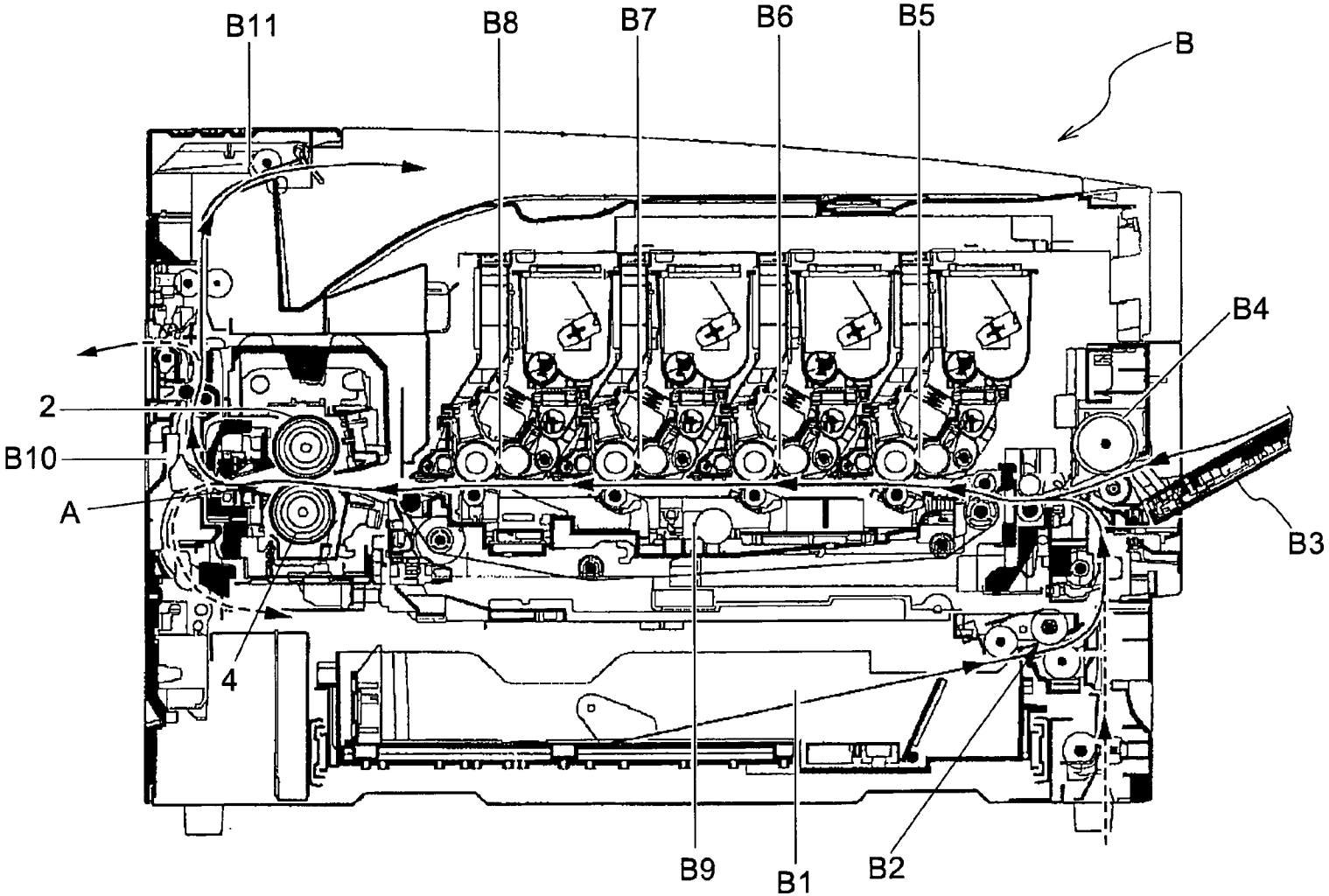
FIG. 1 is a side view showing an interior of a color printer.
Figure 2:
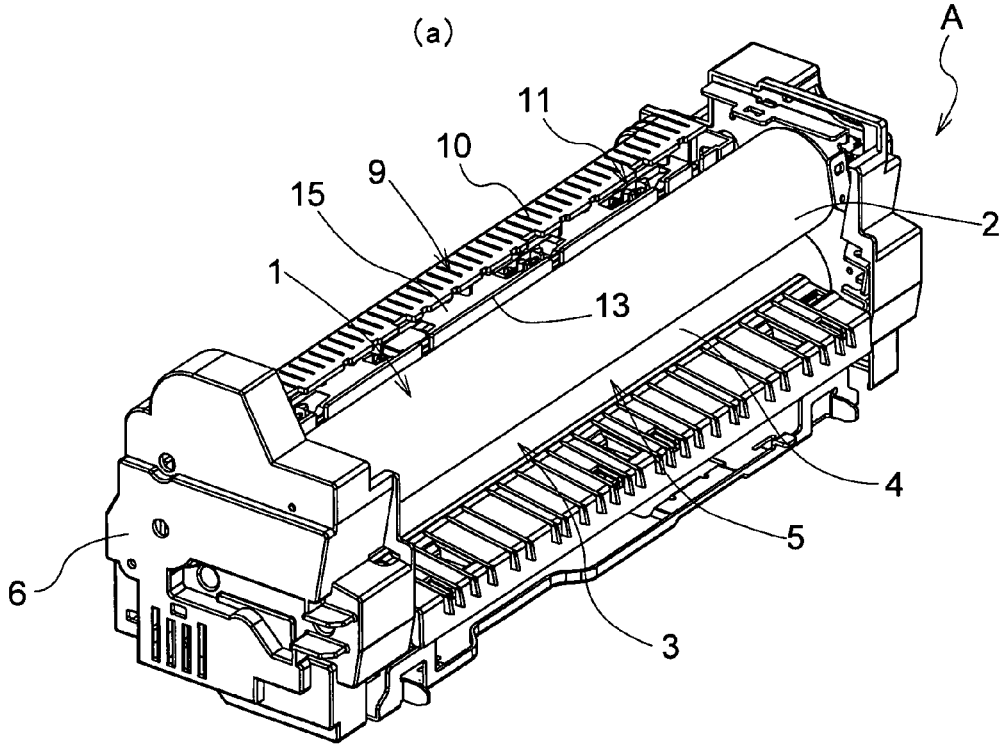
FIG. 2 is a perspective view of a fixing device.
Figure 2:
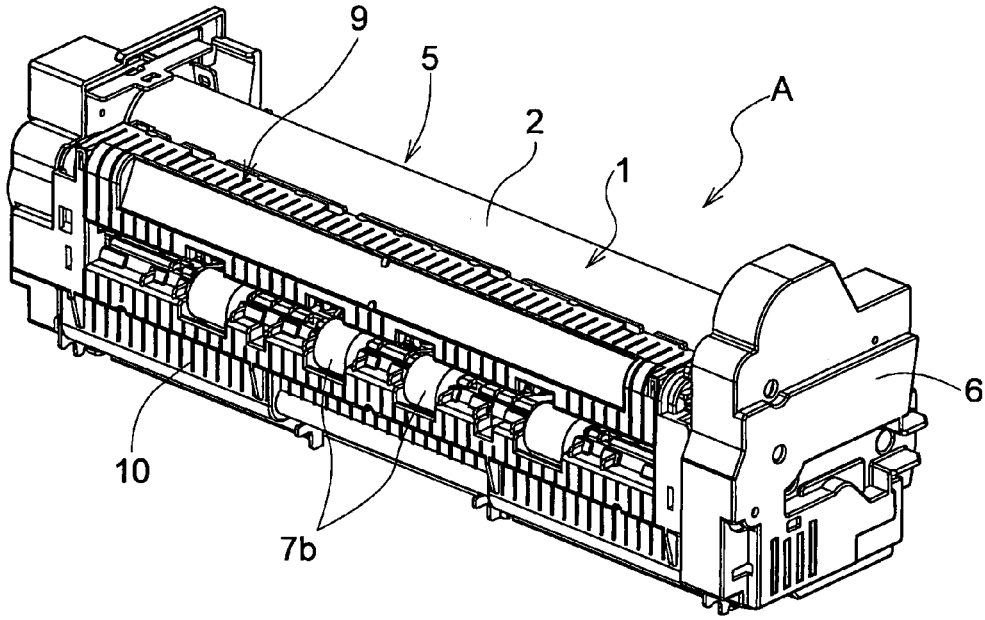
Figure 3:
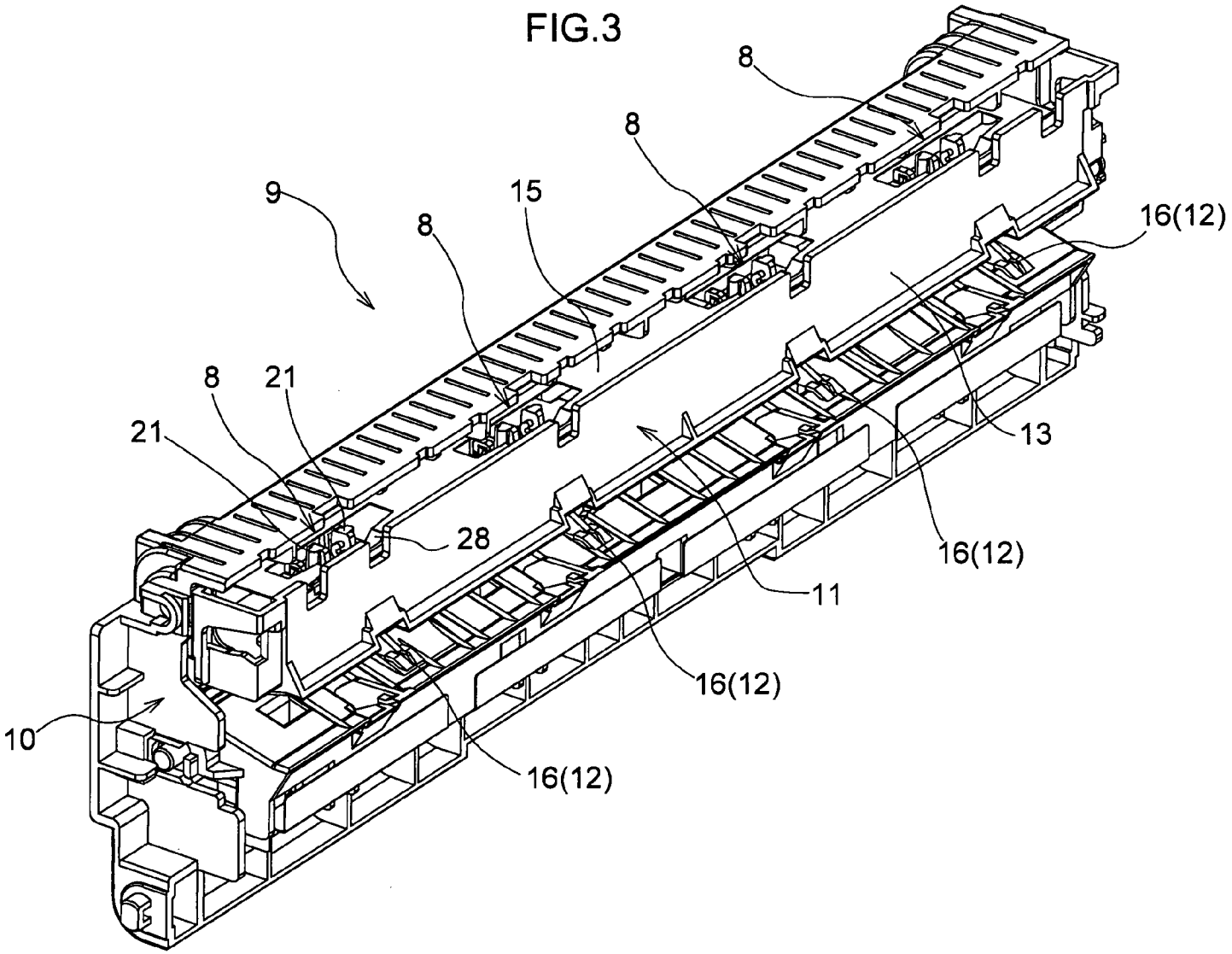
FIG. 3 is a perspective view of elements of the fixing device.
Figure 4:
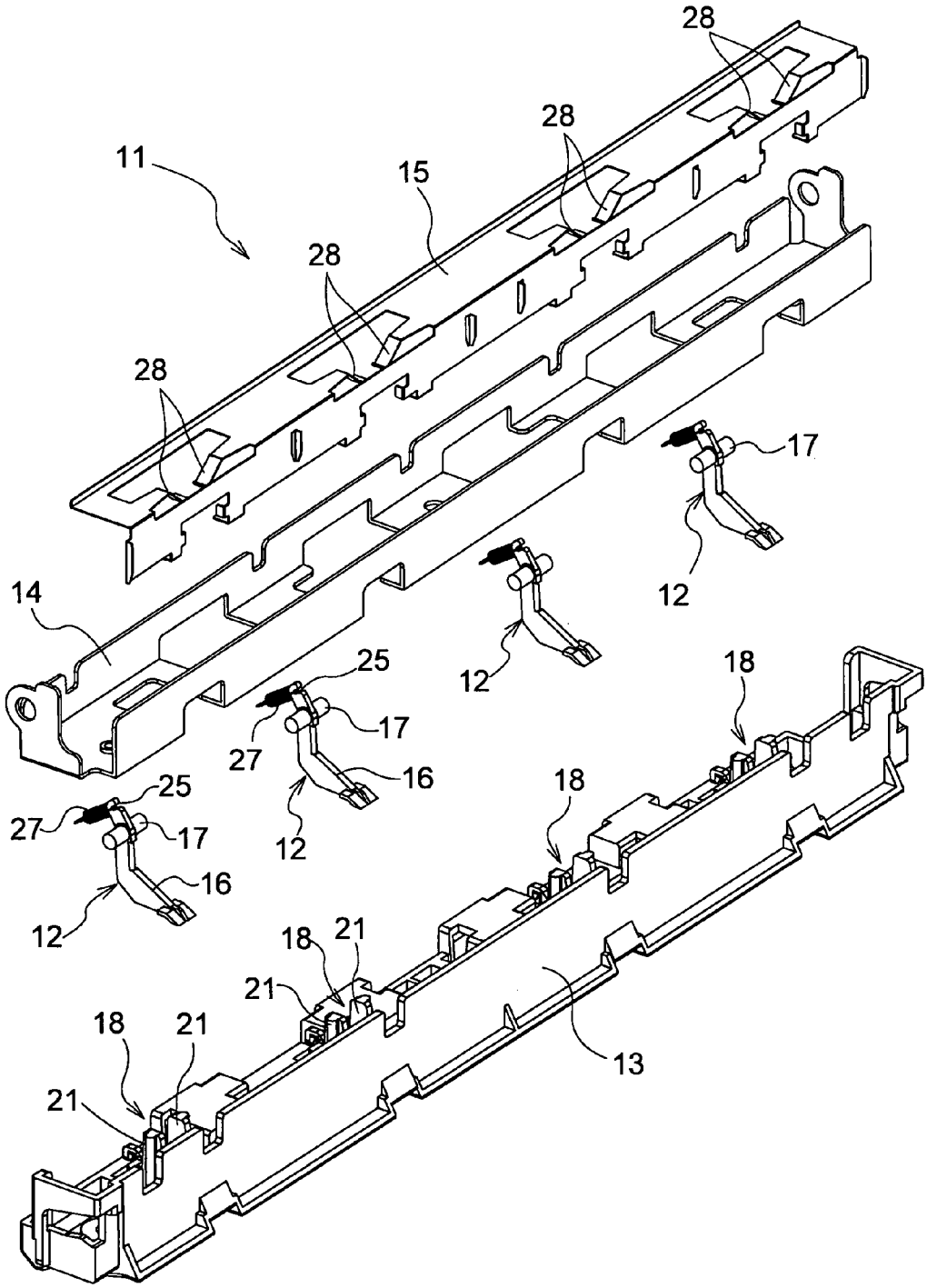
FIG. 4 is an exploded perspective view of elements of the fixing device.
Figure 5:
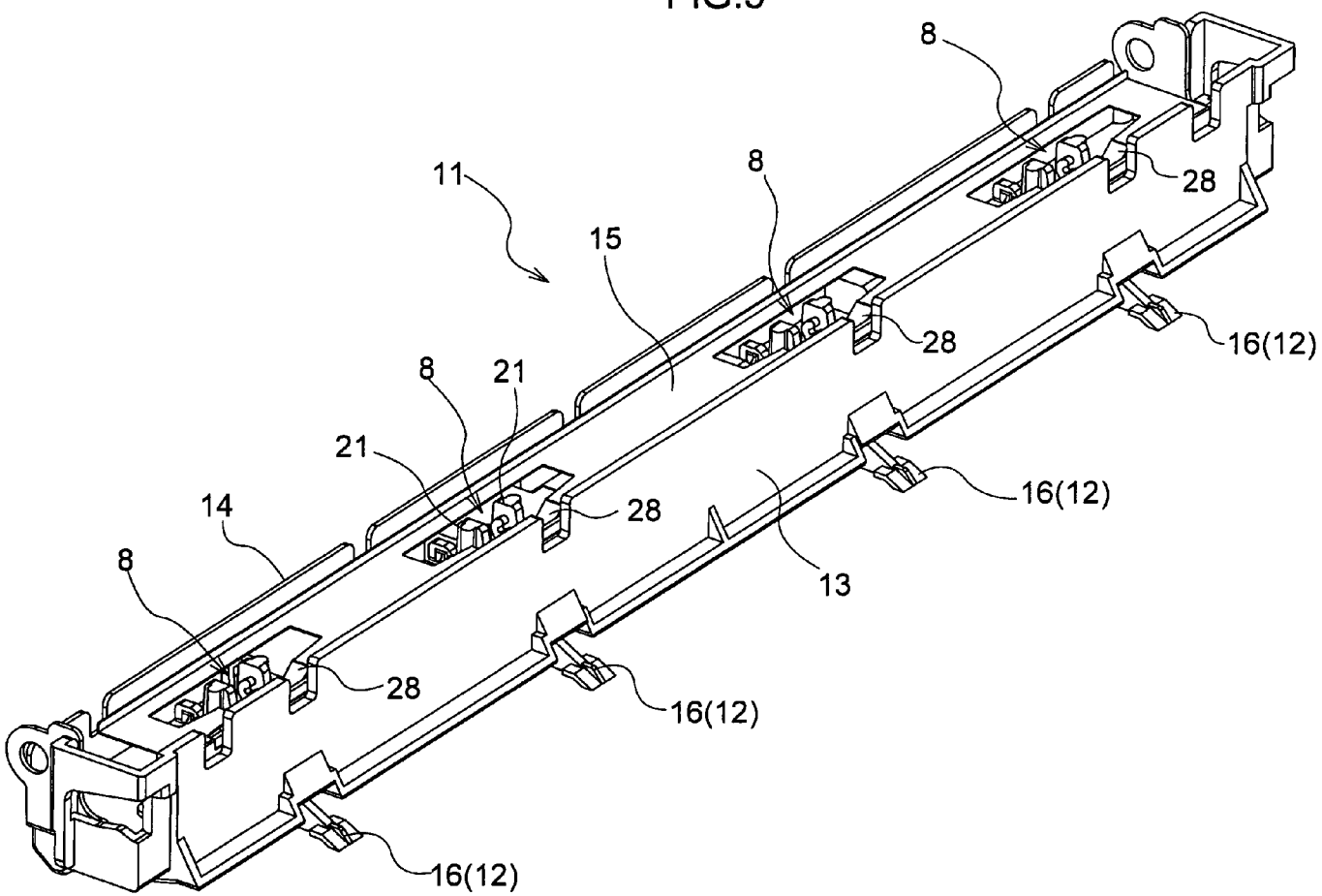
FIG. 5 is a perspective view of elements of the fixing device.
Figure 6:
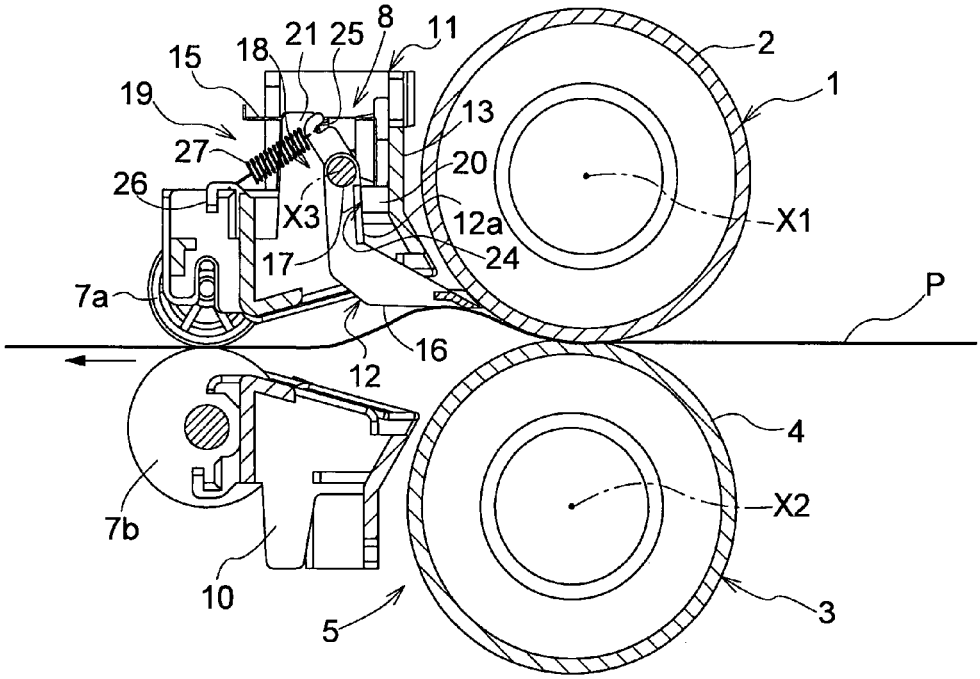
FIG. 6 is a partially cut-away side view created at VI-VI showing elements of the fixing device.
Figure 7:
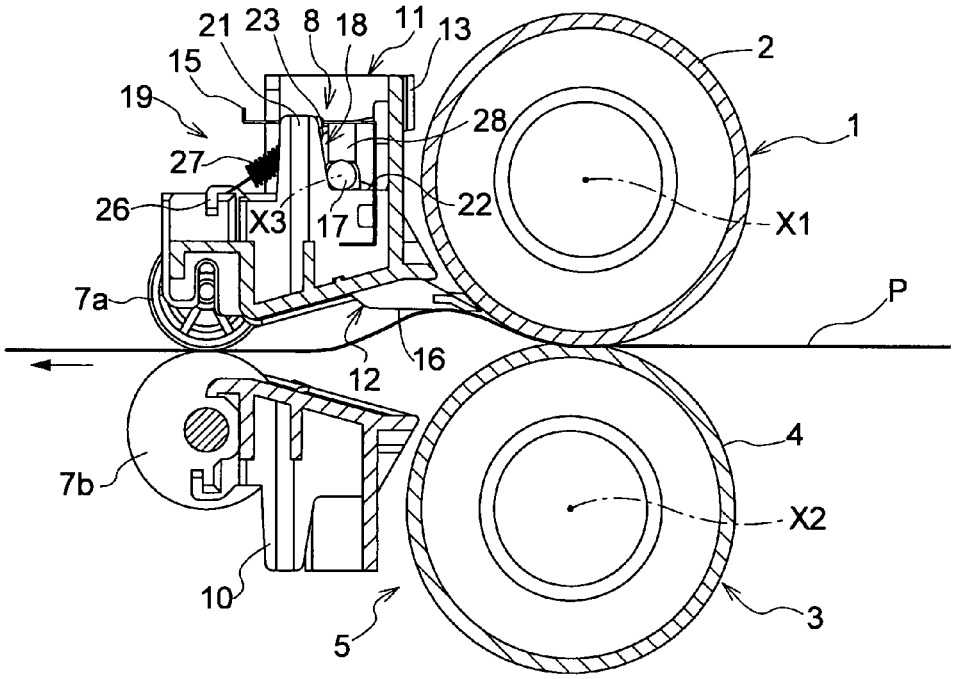
FIG. 7 is a partially cut-away side view created at VII-VII showing elements of the fixing device.
Figure 8:
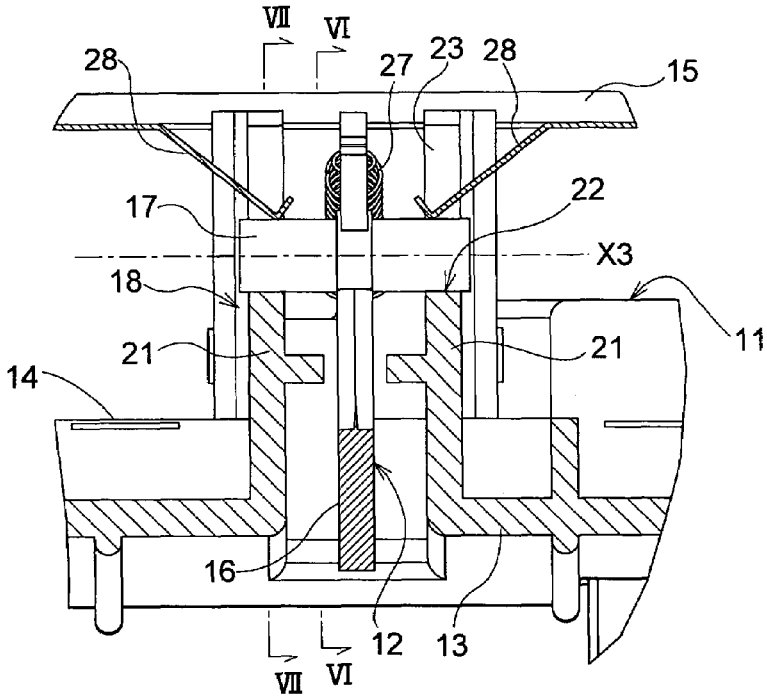
FIG. 8 is a partially cut-away front view showing elements of the fixing device.
Figure 9:
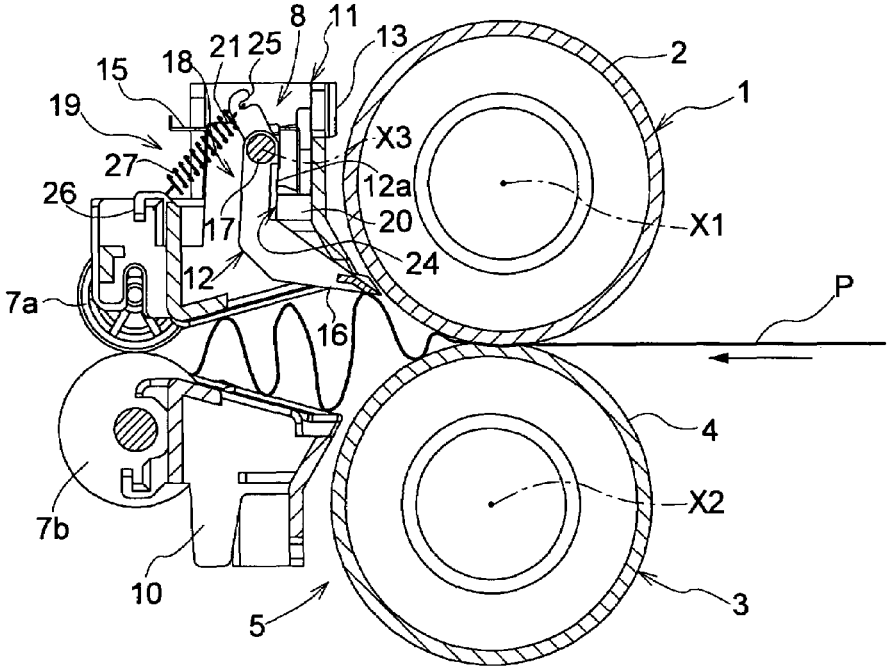
FIG. 9 is a partially cut-away side view showing elements of the fixing device.
Figure 10:
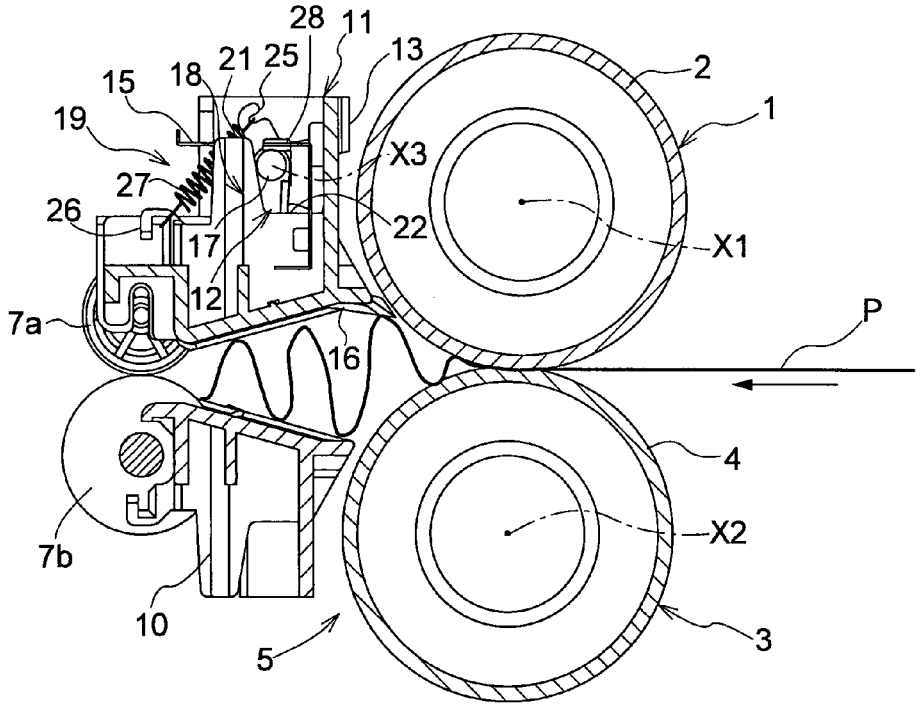
FIG. 10 is a partially cut-away side view showing elements of the fixing device.
Figure 11:
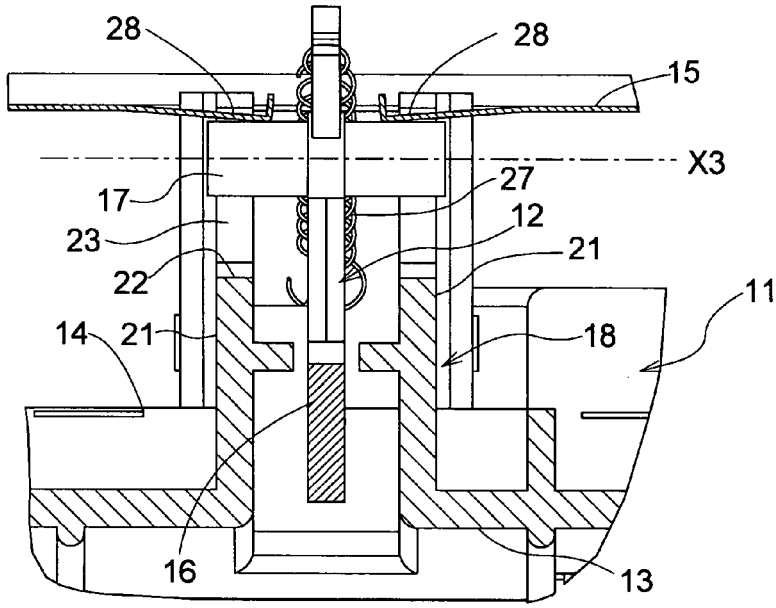
FIG. 11 is a partially cut-away front view showing elements of the fixing device.
Figure 12:
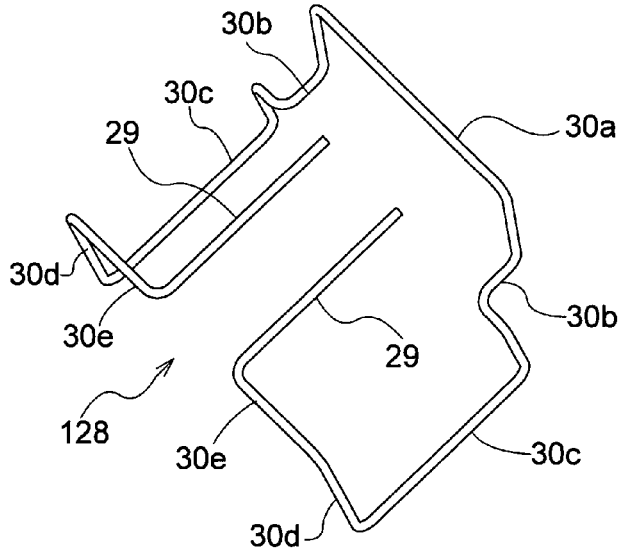
FIG. 12 is a perspective view of elements showing a second embodiment.
Figure 13:
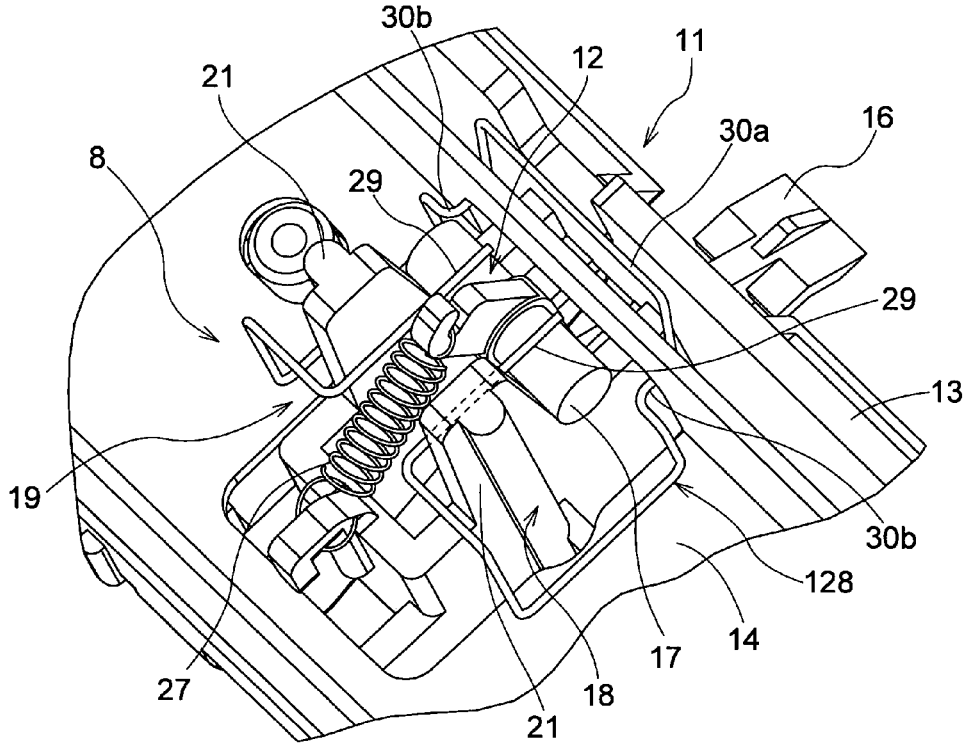
FIG. 13 is a perspective view of elements showing the second embodiment.
Figure 14:
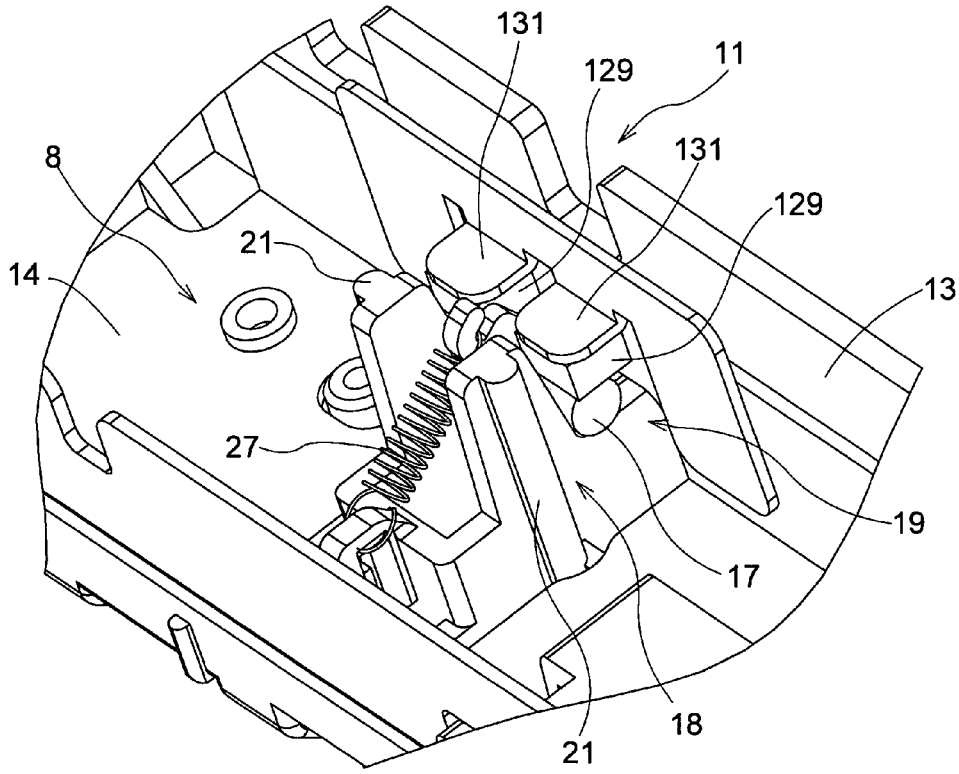
FIG. 14 is a perspective view of elements showing a third embodiment.

What is claimed is:

1. A fixing device comprising:

a fixing part for conveying a sheet of paper that is held between a pressure body and a fixing body that are rotatably supported about substantially parallel shafts while simultaneously fixing supported unfixed toner; and a separation mechanism for separating the sheet of paper, which is carried away from the fixing part, from the fixing body or pressure body; wherein the separation mechanism has a separation member provided with a separation pawl for separating the sheet of paper and a shaft member, a support part for pivotably supporting the separation member via the shaft member so that the separation pawl can be brought near to and separated from the fixing body or pressure body, and a first urging mechanism for pivotably urging the separation member in a direction in which the separation pawl approaches the fixing body or pressure body;

the shaft member is provided so as to be movable between an initial position on the support part for the separation, and a retracted position that is set apart from the fixing part with respect to the initial position;

the urging force created by the first urging mechanism operates such that a pressing force is generated in a direction in which the shaft member is displaced from the retracted position toward the initial position;

wherein a control part is provided for controlling, at said initial position, the pivoting range of the separation pawl toward the fixing body or pressure body by applying a contact pressure;

a second urging mechanism is provided that is separate from the first urging mechanism and that is used for directly pressing and urging the shaft member toward the initial position; and the magnitude of the resultant force of the pressing force created by the urging force created by the first urging mechanism and the pressing force created by the urging force of the second urging mechanism is set such that, in a normal state in which a paper jam has not occurred, the shaft member can be prevented from moving from the initial position to the retracted position regardless of the magnitude of the adhesive force of the sheet of paper on the fixing body or the pressure body, and such that the shaft member is moved from the initial position to the retracted position by contact pressure exerted by a jammed sheet of paper on the separation pawl.

2. The fixing device of claim 1, wherein a plurality of separation mechanisms is provided along shafts of the fixing body and pressure body; and a plurality of second urging mechanisms provided to each shaft member of the separation mechanisms has a plurality of flat-spring-shaped regions formed integrally on a single flat spring member.

3. The fixing device of claim 1, wherein the support member has a support surface extending horizontally and a guide surface extending diagonally upward from the support surface;

the initial position of the shaft member is disposed in the vicinity of a part connecting the support surface and the guide surface;

the retracted position of the shaft member is disposed at a position that extends from the initial position along the guide surface and is set apart from the support surface; and the second urging mechanism is composed of a spring member for pressing the shaft member toward the support surface.

4. The fixing device of claim 1, wherein the second urging mechanism comprises a linear spring member formed by bending a wire member.

5. A fixing device comprising:

a fixing part for conveying a sheet of paper that is held between a pressure body and a fixing body that are rotatably supported about substantially parallel shafts while simultaneously fixing supported unfixed toner; and a separation mechanism for separating the sheet of paper, which is carried away from the fixing part, from the fixing body or pressure body; wherein the separation mechanism has a separation member provided with a separation pawl for separating the sheet of paper and a shaft member, a support part for pivotably supporting the separation member via the shaft member so that the separation pawl can be brought near to and separated from the fixing body or pressure body, and a first urging mechanism for pivotably urging the separation member in a direction in which the separation pawl approaches the fixing body or pressure body;

the shaft member is provided so as to be movable between an initial position on the support part for the separation, and a retracted position that is set apart from the fixing part with respect to the initial position;

the urging force created by the first urging mechanism operates such that a pressing force is generated in a direction in which the shaft member is displaced from the retracted position toward the initial position;

wherein a control part is provided for controlling, at said initial position, the pivoting range of the separation pawl toward the fixing body or pressure body by applying a contact pressure; and a second urging mechanism is provided that is separate from the first urging mechanism and that is used for directly pressing and urging the shaft member toward the initial position.

6. The fixing device of claim 5, wherein a plurality of separation mechanisms is provided along shafts of the fixing body and pressure body; and a plurality of second urging mechanisms provided to each shaft member of the separation mechanisms has a plurality of flat-spring-shaped regions formed integrally on a single flat spring member.

7. The fixing device of claim 5, wherein the support member has a support surface extending horizontally and a guide surface extending diagonally upward from the support surface;

the initial position of the shaft member is disposed in the vicinity of a part connecting the support surface and the guide surface;

the retracted position of the shaft member is disposed at a position that extends from the initial position along the guide surface and is set apart from the support surface; and the second urging mechanism is composed of a spring member for pressing the shaft member toward the support surface.

8. The fixing device of claim 5, wherein the second urging mechanism comprises a linear spring member formed by bending a wire member.

9. An image forming apparatus with a paper feeding unit, a toner process unit, a transcription unit, and a fixing device, the fixing device comprising:

a fixing part for conveying a sheet of paper that is held between a pressure body and a fixing body that are rotatably supported about substantially parallel shafts while simultaneously fixing supported unfixed toner; and a separation mechanism for separating the sheet of paper, which is carried away from the fixing part, from the fixing body or pressure body; wherein the separation mechanism has a separation member provided with a separation pawi for separating the sheet of paper and a shaft member, a support part for pivotably supporting the separation member via the shaft member so that the separation pawi can be brought near to and separated from the fixing body or pressure body, and a first urging mechanism for pivotably urging the separation member in a direction in which the separation pawl approaches the fixing body or pressure body;

the shaft member is provided so as to be movable between an initial position on the support part for the separation, and a retracted position that is set apart from the fixing part with respect to the initial position;

the urging force created by the first urging mechanism operates such that a pressing force is generated in a direction in which the shaft member is displaced from the retracted position toward the initial position;

wherein a control part is provided for controlling, at said initial position, the pivoting range of the separation pawl toward the fixing body or pressure body by applying a contact pressure; and a second urging mechanism is provided that is separate from the first urging mechanism and that is used for directly pressing and urging the shaft member toward the initial position.

* * * * *

UNITED STATES PATENT AND TRADEMARK OFFICE

CERTIFICATE OF CORRECTION

PATENT NO. : 7,702,270 B2
APPLICATION NO. : 11/726729
DATED : April 20, 2010
INVENTOR(S) : Yoshida It is certified that error appears in the above-identified patent and that said Letters Patent is hereby corrected as shown below:

Column 10, Line 13, Claim 9, "separation pawi" should read -- separation pawl --

Column 10, Line 16, Claim 9, "separation pawi" should read -- separation pawl --

Signed and Sealed this

Twenty-fourth Day of August, 2010

David J. Kappos

David J. Kappos
*Director of the United States Patent and Trademark Office*